US010738415B2

(12) United States Patent
Schaepers et al.

(10) Patent No.: US 10,738,415 B2
(45) Date of Patent: Aug. 11, 2020

(54) IRON SUPPORTING APPARATUS, METHOD OF MAKING AND METHOD OF USING THE SAME

(71) Applicant: Polder Products, LLC, Oxford, CT (US)

(72) Inventors: Jochen Rainer Schaepers, New York, NY (US); Craig Daniel Stover, Brooklyn, NY (US)

(73) Assignee: POLDER PRODUCTS, LLC., Oxford, CT (US)

( * ) Notice: Subject to any disclaimer, the term of this patent is extended or adjusted under 35 U.S.C. 154(b) by 84 days.

(21) Appl. No.: 15/923,045

(22) Filed: Mar. 16, 2018

(65) Prior Publication Data

US 2018/0266045 A1 Sep. 20, 2018

Related U.S. Application Data

(60) Provisional application No. 62/472,830, filed on Mar. 17, 2017.

(51) Int. Cl.
*D06F 81/00* (2006.01)

(52) U.S. Cl.
CPC ..... *D06F 81/003* (2013.01)

(58) Field of Classification Search
CPC ..... D06F 81/00; D06F 81/003; D06F 81/006; D06F 75/40; D06F 79/02; D06F 79/023; D06F 79/026
See application file for complete search history.

(56) References Cited

U.S. PATENT DOCUMENTS 1,737,081 A * 11/1929 Foucher ..... D06F 81/003 248/117.4
2,193,414 A * 3/1940 Berkman ..... D06F 81/003 108/63
2,410,534 A * 11/1946 Trevino ..... D06F 81/003 38/107
2,551,285 A * 5/1951 Petersen ..... D06F 79/02 38/107
2,645,045 A * 7/1953 Lewis ..... D06F 81/003 38/107
2,695,762 A * 11/1954 Wersching ..... D06F 81/003 108/135
2,739,398 A 3/1956 Carlesen
(Continued)

FOREIGN PATENT DOCUMENTS

EP 0131547 A2 1/1985
GB 469861 A 8/1937

OTHER PUBLICATIONS

Extended European Search Report dated Aug. 27, 2018, in corresponding European Patent Application No. 18162421.4.

*Primary Examiner* — Ismael Izaguirre
(74) *Attorney, Agent, or Firm* — Duane Morris LLP

(57) ABSTRACT

An apparatus for ironing fabric-containing articles is provided. The apparatus includes a board having a top surface, and a tray movably coupled with the board. The tray comprises a base portion, and a top portion coupled with the base portion. The tray is configured to be movable from an open configuration to a closed configuration. In the open configuration, one end of the tray is extended away from the board. An iron can be placed onto the top portion of the tray. In the closed configuration, the tray is folded onto a portion of the board for storage.

21 Claims, 15 Drawing Sheets

(56) References Cited

U.S. PATENT DOCUMENTS

| | | | | | |
|---|---|---|---|---|---|
| 2,904,296 | A | * | 9/1959 | Graham | D06F 81/003 248/117.7 |
| 2,931,609 | A | * | 4/1960 | Haussner | D06F 81/003 38/107 |
| 2,994,144 | A | | 8/1961 | Hattie | |
| 3,055,129 | A | * | 9/1962 | Selleck | D06F 81/00 108/135 |
| 4,525,942 | A | * | 7/1985 | Azzara | D06F 81/006 211/119.001 |
| 4,574,503 | A | * | 3/1986 | Bertani | D06F 75/12 248/117.1 |
| 5,926,984 | A | * | 7/1999 | Zuber | D06F 81/003 38/107 |

* cited by examiner

IRON SUPPORTING APPARATUS, METHOD OF MAKING AND METHOD OF USING THE SAME

PRIORITY CLAIM AND CROSS-REFERENCE

This application claims the priority benefit of U.S. Provisional Application No. 62/472,830, filed Mar. 17, 2017, which application is expressly incorporated by reference herein in its entirety.

FIELD

The disclosure relates to home accessories generally. More particularly, the disclosed subject matter relates to an apparatus for supporting a pressing iron, the method of making and the method using the same.

BACKGROUND

In an ironing or pressing process, a heated tool, such as an iron, is used to remove wrinkles from fabric. The iron may be heated to a temperature of 180-220° C., depending on the fabric. The bonds between the long-chain polymer molecules in the fibers of the fabric are loosened upon heating. While the molecules are warm or hot, the fibers are straightened by the weight of the iron. When the fabric is cooled down to room temperature, the fibers hold their straightened shape. Some fabrics, such as cotton, require the addition of water during the ironing process to loosen the intermolecular bonds.

A pressing apparatus or system includes an iron and an ironing board for pressing or smoothing clothes, sheets or other articles made from fabric material. The iron is heated before and during the use, and is generally placed vertically on the ironing board.

SUMMARY

The present disclosure provides an apparatus such as an iron supporting apparatus, the method of making, and the method using the same. Such as an iron supporting apparatus is used for ironing, pressing, or smoothing fabric-containing articles such as clothes and sheets.

In some embodiments, such an apparatus comprises a board having a top surface and a bottom surface and extending from a first end to a second end, and a tray coupled with the board. The tray extends from a first end to a second end. The tray comprises a base portion, and a top portion coupled with the base portion.

In some embodiments, the tray is movably coupled with the board. The tray is configured to be movable from an open configuration to a closed configuration. The tray may be rotatable or slidable and be selectively positioned in the open or closed configuration. For example, the first end of the tray may be pivotally coupled to the first end of the board. The tray is shaped and sized to be foldable (or flappable), and configured to be folded onto the board to provide a folded or closed configuration. In the open configuration, one end (e.g., the second end) of the tray is extended away from the board. The top surface of the tray and the top surface of the board may be in the same or a different plane, but the planes are generally parallel to one another. In the folded or closed configuration, the tray is folded such that the tray is positioned adjacent to a portion of the board. For example, the tray may be positioned such that it is positioned in proximity to the top or back surface of the board. In some embodiments, the top face of the tray is in contact with a portion of the top surface of the board in the folded configuration. The top face of the tray may be in direct face-to-face contact with a portion of the top surface of the board in the folded configuration in some embodiments. The unfolded or open configuration is an in-use configuration, and a pressing iron can be placed onto the top portion of the tray. The folded configuration is for storage. In some embodiments, the tray includes a strap for securing a pressing iron to the ironing board assembly (i.e., an ironing board and a tray) for storage.

Either of the base portion and the top portion of the tray comprises or is made of plastics, metal or ceramic. Examples of a suitable metallic material include but are not limited to aluminum, steel, iron, alloy or other suitable metal. In some embodiments, the base portion of the tray is made of a plastic, which is thermal resistant. The top portion of the tray comprises or is made of an elastomer, which is thermal resistant. Examples of a suitable elastomer include but are not limited to silicone, fluorosilicone, fluoroleastomer (FKM), perfluoroelastomer (FFKM), or any combination thereof.

The top portion of the tray may be molded or bonded onto the base portion of the tray. In some embodiments, the top portion of the tray may be mechanically interlocked with and coupled with the base portion of the tray. In some embodiments, the base portion of the tray defines one or more cavities therein for the top portion. The top portion of the tray is molded or bonded with the base portion in the one or more cavity. In some embodiments, the base portion defines one cavity and the top portion is molded to fill the cavity to form a top surface of the tray, which may be smooth or has a molded pattern.

The apparatus further comprises a hinge device disposed between and coupled with the board and the tray. In some embodiments, the hinge device comprises at least one hinge, or any other suitable attachment means, for coupling the tray to the board. The at least one hinge or any other suitable attachment means comprises a metal or plastic in some embodiments. In some embodiments, the hinge device comprises a hinge bracket. The hinge bracket may include a shelf extending away from the board. The shelf is configured to partially support the tray disposed above the shelf in the open configuration. In some embodiments, the hinge device comprises a lock and a button configured to lock the tray in the open or closed configuration and release the tray so that the tray is movable between the open configuration and the closed configuration. In some embodiments, the lock may be disposed inside the hinge bracket. The button is connected with the lock, and has a portion disposed outside the hinge bracket configured to be pressed and release the lock.

In some embodiments, the apparatus further comprises a supporting member connected with the hinge device and the board. The supporting member is a wire or rod (e.g., U-shaped metal wire) partially disposed inside the hinge bracket and partially inserted into the hole or holes on the bottom of the board.

The board comprises a body comprising or being made of metal or ceramic in a sheet form, and a cover comprising a fabric sheet. Examples of a suitable metallic material include but are not limited to aluminum, steel, alloy or other suitable metal. The apparatus further comprises at least two supporting legs coupled with the board and configured to support the board. The legs may be collapsible toward the board for storage. For example, the apparatus comprises for four supporting legs coupled with the board in some embodiments. At least two supporting legs are orientated in a pair along one direction.

In some embodiments, the base portion or the top portion of the tray defines at least one depression configured to hold a bottle, a cup, a spray can, a container or the like.

The apparatus may further comprise a strap or belt disposed on a back wall of the tray and configured to fasten an iron when the tray in the closed configuration. In some embodiments, a strap or belt is coupled to and extended from one side of the tray. The strap, which can have an elongated shape, is configured to at least partially wrap around the tray (including the iron), and may be coupled the tray or the board in a folded configuration. The strap has one end, which is configured to be removably coupled with the tray or the board in a folded configuration. The board may comprise a fixture for removably connecting with the end of the strap. In some embodiments, the strap is an integral extension of the top portion of the tray, and the strap and the top portion are in a unitary structure. The strap and the top portion of the tray are made of the same heat-resistant elastomer. The strap is a flexible. The base portion of the tray may have one side with one gap for the strap.

In some embodiments, the strap is a belt separate and different from the tray. The strap has two ends: a first end and a second end. The first end is fixed to the back of the tray through a hook in the first end and a first pin on the back of the tray. The pin is inserted into the hook. The second end of the strap has a hook, which can be removably coupled with a second pin on the back of the tray. The belt is configured to at least partially wrap around the tray and fasten an iron onto the tray after the tray is folded onto the board. The second end of the strap is then coupled with the second pin.

In some embodiments, the base portion of the tray comprises a side wall defining at least one hanger rail configured to hold one or more hangers. In some embodiments, the base portion of the tray may comprise a hanger portion or bar, which is disposed and coupled with base portion of the tray. The hanger portion may be made the same material for the base portion, and the hanger portion and the base portion may have unitary structure. For example, the hanger portion and the base portion are made of metal. The hanger portion may be oriented at an angle (e.g., 90 degree) from the plane of the base portion. The hanger portion defines an opening (at least two openings), and is configured to hold at least one hanger therein. In some embodiment, the base portion and the hanger portion have a polished or treated surface, and optionally coated with a thin film of plastics or rubber.

In another aspect, the method of making the described apparatus also is disclosed. Such a method comprises steps of providing the board as described, and forming the tray as described. The method further comprises forming a hinge device, and assembling the board, the tray and the hinge device together. The hinge device is placed between and couples the tray to the board.

In some embodiments, the method of making the apparatus comprises providing the board, providing the base portion of the tray, forming the top portion on the base portion, and assembling the board and the tray to provide the apparatus. The top portion of the tray can be molded or bonded onto, or mechanical interlocked with the base portion. In some embodiments, the top portion and the strap can be molded simultaneously or sequentially, with the same or different materials of the same or different colors. In some embodiments, the top portion and the strap can be molded to form a unitary structure using a thermal-resistant elastomer, such as silicone. In some embodiments, the strap is a belt separate and different from the tray, and is installed onto the back of tray. The method of making may also comprise forming a hanger portion coupled to the base portion. The hanger portion is molded or partially cut out to provide at least one opening, which is configured to hold a hanger for the clothes or other fabric-containing articles.

In another aspect, the method of using the described apparatus also is disclosed. The method of using comprises moving the tray to one of the folded configuration and the unfolded configuration. The method comprises moving the tray from a first position or configuration to a second position or configuration. In some embodiments, the first position or configuration is an open position or configuration. In some embodiments, the first position or configuration is a closed position or configuration. The method further comprises placing an iron onto the top portion of the tray when the tray is in the open configuration. The method further comprises fixing an iron onto a back wall of the base portion of the tray when the tray is in the closed configuration.

The tray can be unfolded with one end extended away from the board. This unfolded or open configuration is an in-use configuration. A pressing iron, even when it is heated, can be placed onto the top portion of the tray, when the iron is idle. The heated pressing iron can be used to press an article placed on the board. The tray can be folded onto the board to provide a folded or closed configuration as described. In some embodiments, the strap or belt fastened the iron onto the back of the tray. The tray functions as a heat sink. Even when the iron is hot, the iron can be fastened onto the back of the tray. The strap can be coupled with a pin on the back of the tray. In some embodiments, the strap has an end to be coupled with the tray or the board. The apparatus can be stored in the folded configuration before next use.

The apparatus provided in the present disclosure has many advantages. For example, the apparatus provides a tray to place a hot iron during ironing. The tray can be easily folded onto the board. A iron can be packed with the tray and the board even when the iron is very hot right after use. The iron and the apparatus can be stored in a limited space after each use.

BRIEF DESCRIPTION OF THE DRAWINGS

The present disclosure is best understood from the following detailed description when read in conjunction with the accompanying drawings. It is emphasized that, according to common practice, the various features of the drawings are not necessarily to scale. On the contrary, the dimensions of the various features are arbitrarily expanded or reduced for clarity. Like reference numerals denote like features throughout specification and drawings.

DETAILED DESCRIPTION

Figure 1:
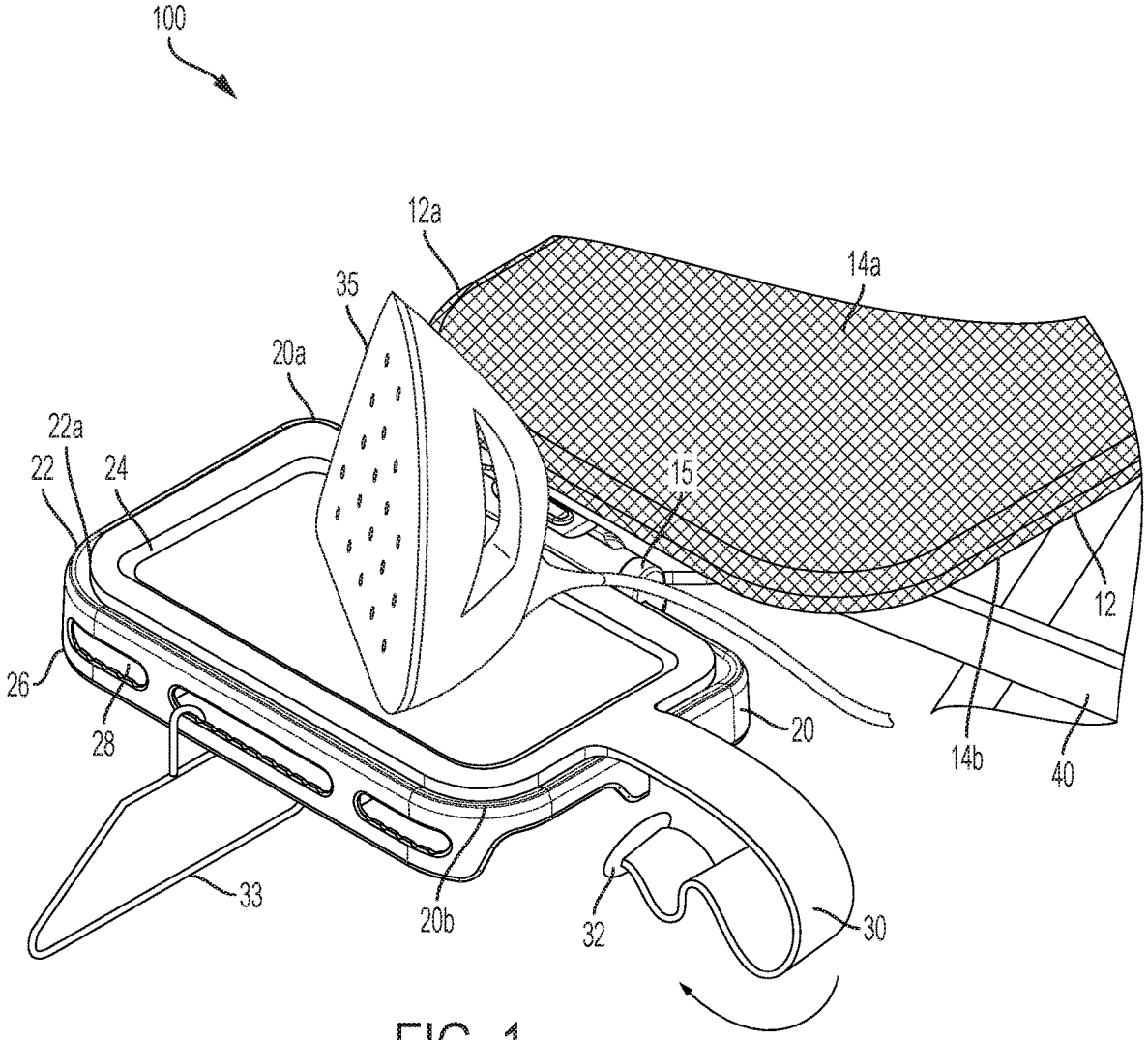
FIG. 1 is a perspective view of an exemplary apparatus in an unfolded or open configuration in accordance with some embodiments.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

For purposes of the description hereinafter, it is to be understood that the embodiments described below may assume alternative variations and embodiments. It is also to be understood that the specific articles, compositions, and/or processes described herein are exemplary and should not be considered as limiting.

In the present disclosure the singular forms "a," "an," and "the" include the plural reference, and reference to a particular numerical value includes at least that particular value, unless the context clearly indicates otherwise. When values are expressed as approximations, by use of the antecedent "about," it will be understood that the particular value forms another embodiment. As used herein, "about X" (where X is a numerical value) preferably refers to ±10% of the recited value, inclusive. For example, the phrase "about 8" preferably refers to a value of 7.2 to 8.8, inclusive. Where present, all ranges are inclusive and combinable. For example, when a range of "1 to 5" is recited, the recited range should be construed as including ranges "1 to 4", "1 to 3", "1-2", "1-2 & 4-5", "1-3 & 5", "2-5", and the like. In addition, when a list of alternatives is positively provided, such listing can be interpreted to mean that any of the alternatives may be excluded, e.g., by a negative limitation in the claims. For example, when a range of "1 to 5" is recited, the recited range may be construed as including situations whereby any of 1, 2, 3, 4, or 5 are negatively excluded; thus, a recitation of "1 to 5" may be construed as "1 and 3-5, but not 2", or simply "wherein 2 is not included." It is intended that any component, element, attribute, or step that is positively recited herein may be explicitly excluded in the claims, whether such components, elements, attributes, or steps are listed as alternatives or whether they are recited in isolation.

The present disclosure provides an apparatus, such as an apparatus for use when ironing.

In FIGS. 1-10, like items are indicated by like reference numerals, and for brevity, descriptions of the structure, provided above with reference to the preceding figures, are not repeated.

Figure 2:
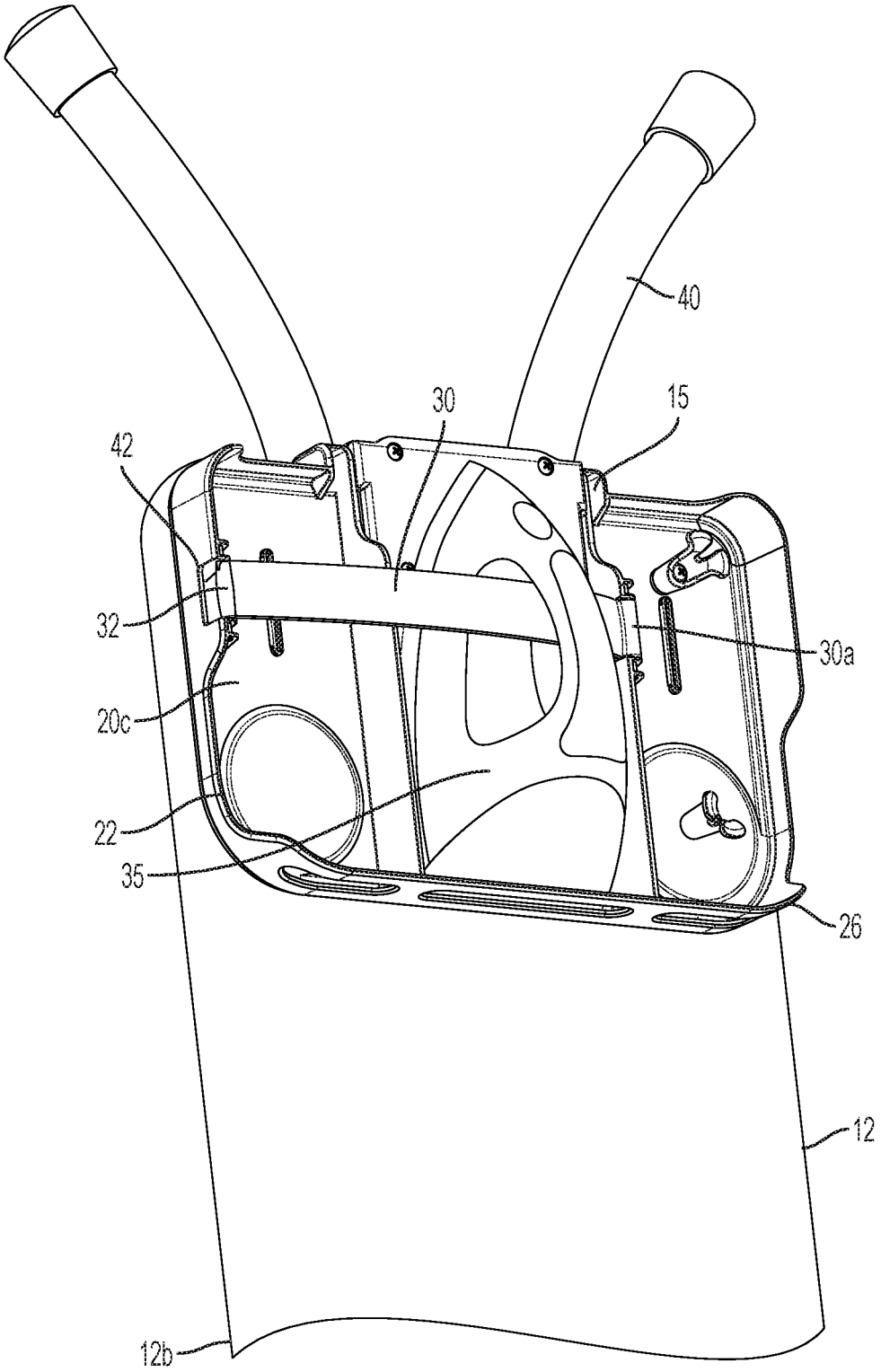
FIG. 2 is a perspective view of the exemplary apparatus of FIG. 1 in a folded or closed configuration.

Referring to FIGS. 1-2, in some embodiments, an exemplary apparatus 100 comprises a board 12 having a top surface 14*a* and a bottom surface 14*b* and extending from a first end 12*a* and a second end 12*b* (not fully shown in FIGS. 1-2), and a tray 20 coupled with the board 12. The tray 20 extends from a first end 20*a* to a second end 20*b*. The tray 20 comprises a base portion 22 and a top portion 24. The top portion 24 comprises or is made of a polymer, such as a heat-resistant elastomer as described herein. The tray 20 has a flat or patterned top surface and is configured to support an iron 35.

The tray 20 is shaped and sized to be movable (e.g., rotatable or slidable) and be selectively positioned from an open or unfolded configuration, as shown in FIG. 1, to a folded or closed configuration, as shown in FIG. 2. For example, the first end 20*a* of the tray 20 may be pivotally coupled to the first end 12*a* of the board 12*b*. In the open configuration of FIG. 1, one end such as the second end 20*b* of the tray 20 extends away from the board 12. The top surface of the tray 20 and the top surface of the board 12 are in the same or a different plane with the plane defined by the top surface of the tray 20 and top surface of the board 12 being parallel or substantially parallel to one another. In the folded configuration, the tray 20 is folded such that the tray is disposed adjacent to a portion of the board 12. For example, the tray 20 is folded such that the tray is positioned adjacent to a portion of the top or back surface of the board 12. In some embodiments, the top face of the tray 20 is in contact with a portion of the top surface 14*a* of the board 12 in the folded configuration. The unfolded or open configuration is an in-use configuration and a pressing iron 35 can be placed onto the top portion of the tray 20. The folded or closed configuration is for storage.

Referring to FIGS. 1-2, apparatus 100 further comprises a hinge device 15 (or connector structure), for coupling the tray 20 onto the board 12. The hinge device 15 may include at least one hinge or any other suitable attachment means. In some embodiments, the hinge device 15 includes one or more hinges. The hinge device 15 may comprise or be made of metal or plastics.

The board 12 comprises a body comprising or being made of metal or ceramic in a sheet form, and a cover comprising a fabric sheet. Examples of a suitable metallic material include, but are not limited to, aluminum, steel, alloy or other suitable metal. Apparatus 100 further comprises at least two supporting legs 40 coupled with the board 12 and configured to support the board 12.

The base portion 22 of the tray 20 comprises or is made of plastic, metal or ceramic. The plastic has desired thermal resistance, for example, resistance to a temperature in the range of from 100° C. to 200° C. (e.g., 150-200° C., or 180-200° C.). Examples of a suitable plastic materials include, but are not limited to, polyamide such as polyphthalamide (PPA), polyester, polyphenylene sulfide (PPS), polyolefin, and any combination thereof. Examples of a suitable metallic material include but are not limited to aluminum, steel, iron, alloy or other suitable metal. In some embodiments, the base portion 22 comprises a thermally conductive materials such as metal, and functions as a heat sink. A hot iron 35 can be packed contacting the base portion 22 in a closed configuration.

In some embodiments, the apparatus 100 further comprises a strap or belt 30 coupled to and extending from a back side (or wall) 20*c* of the tray 20. The strap 30, which can have an elongated shape, is configured to couple the iron 35 to the back side 20*c* of the tray 20 in a folded configuration (as illustrated in FIG. 2). The strap 30 may go through the handle of an iron, e.g., iron 35. The strap 30 has a first end 30*a* coupled to the tray 20. The tray 20 or the board 12 may comprise a fixture 42, and the end 32 of the strap 30 may be removably coupled with the fixture 42. In some embodiments, the strap 30 is an integral extension of the top portion 24 of the tray 20, and the strap 30 and the top portion 24 are a unitary structure. The strap 30 and the top portion 24 are made of the same heat-resistant elastomer, which also is flexible. The base portion 22 of the tray 20 may have one side with one gap on its edge for the strap 30.

In some embodiments, the top portion 24 of the tray 20 may comprises a metal, a ceramic, or a thermal resistant polymer such as plastic, rubber or elastomer. The thermal resistant polymer such as an elastomer may have a continuous use temperature of 100° C. or above, which can be in the range from 100° C. to 350° C. (e.g., 150-200, 200-300, 300-350° C.). The polymer may have a glass transition temperature above 25° C. The temperature rating and glass transition temperature can be measured following ASTM standards using thermal analysis techniques. Examples of a suitable elastomer include but are not limited to silicone, fluorosilicone, fluoroleastomer (FKM), perfluoroelastomer (FFKM), and any combination thereof.

The top portion 24 and/or strap 30 may have flexibility. The flexibility can be defined based on its Shore A hardness, which may be in the range of from 20 to 90 measured following ASTM D 2240. A Shore A hardness less than or equal to 70 can be flexible for the strap 30. The top portion 24 and/or strap 30 may have a shore A hardness of any suitable ranges, for example, 20-70, 30-70, 40-70, 50-70, 30-60, 40-60, or any other combination. The top portion 24 and/or strap 30 may also have a shore D hardness in the range from 10 to 50.

The top portion 24 and/or strap 30 may be made of an elastomer, preferably a hydrophobic and mold resistant elastomer. For example, top portion 24 and strap 30 are made of a hydrophobic elastomer having a shore A hardness in the range from 20 to 85 (for example, 20-70, 30-70, 40-70, 50-70, 30-60, 40-60) in some embodiments. In some embodiments, top portion 24 and strap 30 are made of silicone, fluorosilicone, fluoroelastomer, or any combination thereof. The elastomer may be reinforced with fillers.

The top portion 24 of the tray 20 can be molded or bonded onto the base portion 22 of the tray 20. In some embodiments, the base portion 22 defines one or more cavities 22*a* therein for the top portion 24. The top portion 24 of the tray 20 is molded or bonded with the base portion 22 in the one or more cavities 22*a*. In some embodiments, the base portion 22 defines one cavity 22*a* and the top portion 24 is molded to fill the one or more cavities 22*a* so as to form a smooth top surface of the tray 20.

In some embodiments, the base 22 further comprises a hanger portion or bar 26, which is disposed and coupled with base portion 22 of the tray 20. The hanger portion 26 may be made from the same material for the base portion 22. In some embodiments, the hanger portion 26 and the base portion 22 are a unitary structure. For example, the hanger portion 26 and the base portion 22 are made of metal. The hanger portion 26 may be oriented at an angle (e.g., 90 degrees) from the plane of the base portion 22. The hanger portion 26 defines at least one opening) 28 and is configured to hold at least one clothes hanger 33 therein. In some embodiment, the base portion 22 and the hanger portion 26 have a polished or treated surface, and optionally coated with a thin film of plastics or rubber.

The exemplary apparatus 100 can be made through steps including providing the board 12, providing the tray 20, and coupling the board 12 to the tray 20 to provide the apparatus 100. The step of providing the tray 20 may comprise a step of providing the base portion 22 and forming the top portion 24 on the base portion 22. The top portion 24 can be molded or bonded to, or mechanically interlocked with, the base portion 22. The top portion 24 and the strap 30 can be molded or provided simultaneously, or separately sequentially, with the same or different materials of the same or different colors. In some embodiments, the top portion 24 and the strap 20 can be molded together to form a unitary structure from a thermal-resistant elastomer, such as silicone. The method may also comprise forming a hanger portion 26 coupled to the base portion 22. The hanger portion 22 can be partially cut out to provide at least one opening 28 and configured to hold at least one clothes hanger 33 therein.

When the exemplary apparatus 100 is used, the tray 20 is moved from a first position to a second position. For example, the tray 20 may be moved from a folded or closed position to the unfolded or open configuration. The unfolded configuration is an in-use configuration. A pressing iron 35, even when it is heated, can be placed onto the top portion 24 of the tray 20, when the iron 35 is idle. The heated pressing iron 35 can be used to press an article placed on the board. When the ironing or pressing has been completed, the tray 20 can be folded relative to the board 12 to provide a folded configuration. The iron 35, even when it is hot, can be placed onto the back surface of the tray 20*c* and strapped to the tray 20 or the board 12. The base portion 22 of the tray 20 acts as a heat sink to help cool down the iron 35 while at the same time enabling the immediate storage of the iron 35 and the board 12 together. In some embodiment, the end 32 of the strap 30 can be coupled with the board 12 through a fixture 42 on the board 12. The apparatus 10 can be stored in the folded configuration. The apparatus 10 can be unfolded during a subsequent use.

FIGS. 3-10 illustrates an exemplary apparatus 200 in accordance with some embodiments. The descriptions of the exemplary apparatus 100 also apply to the exemplary apparatus 200 except the shape of top portion 24, and the unitary structure of the strap 30 and the top portion 24, as shown in FIG. 1. FIG. 2 also applies to the exemplary apparatus 200.

Figure 3:
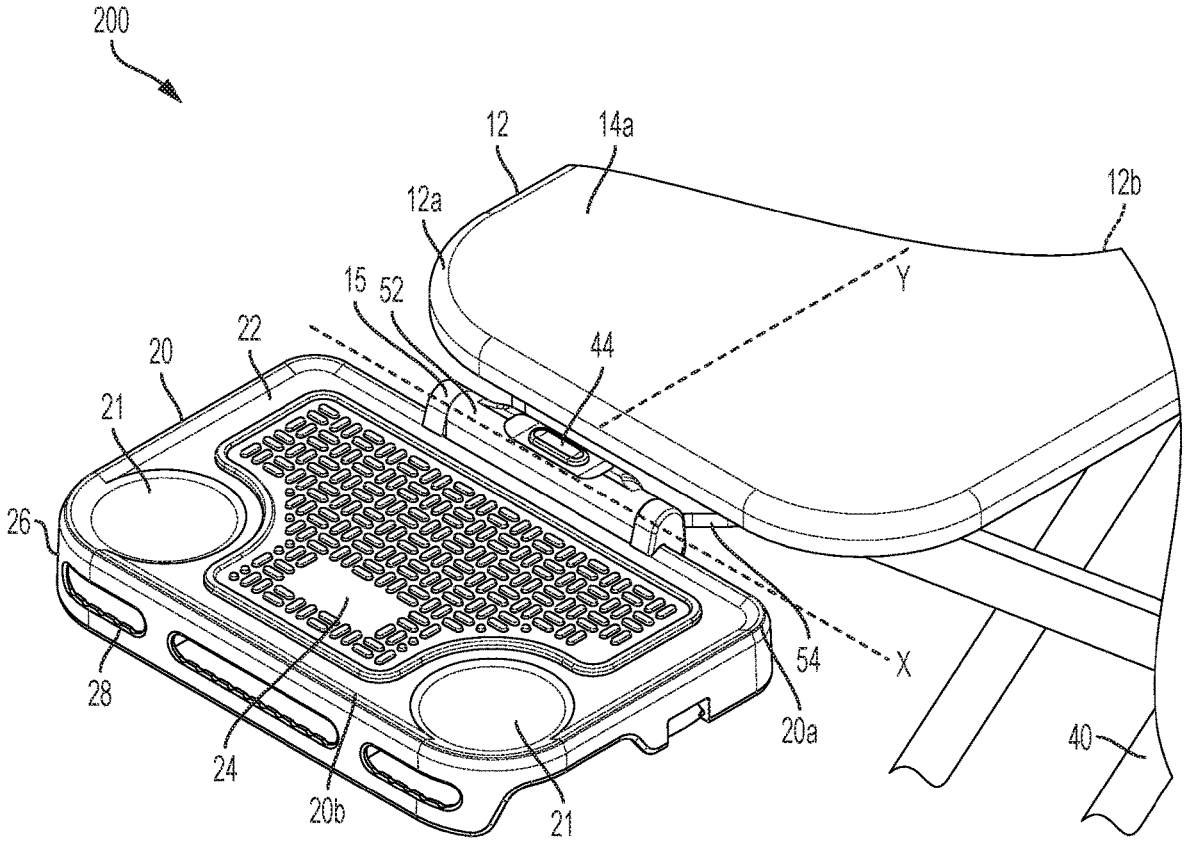
FIG. 3 is a perspective view of another exemplary apparatus in an unfolded or open configuration in accordance with some embodiments.
Figure 4:
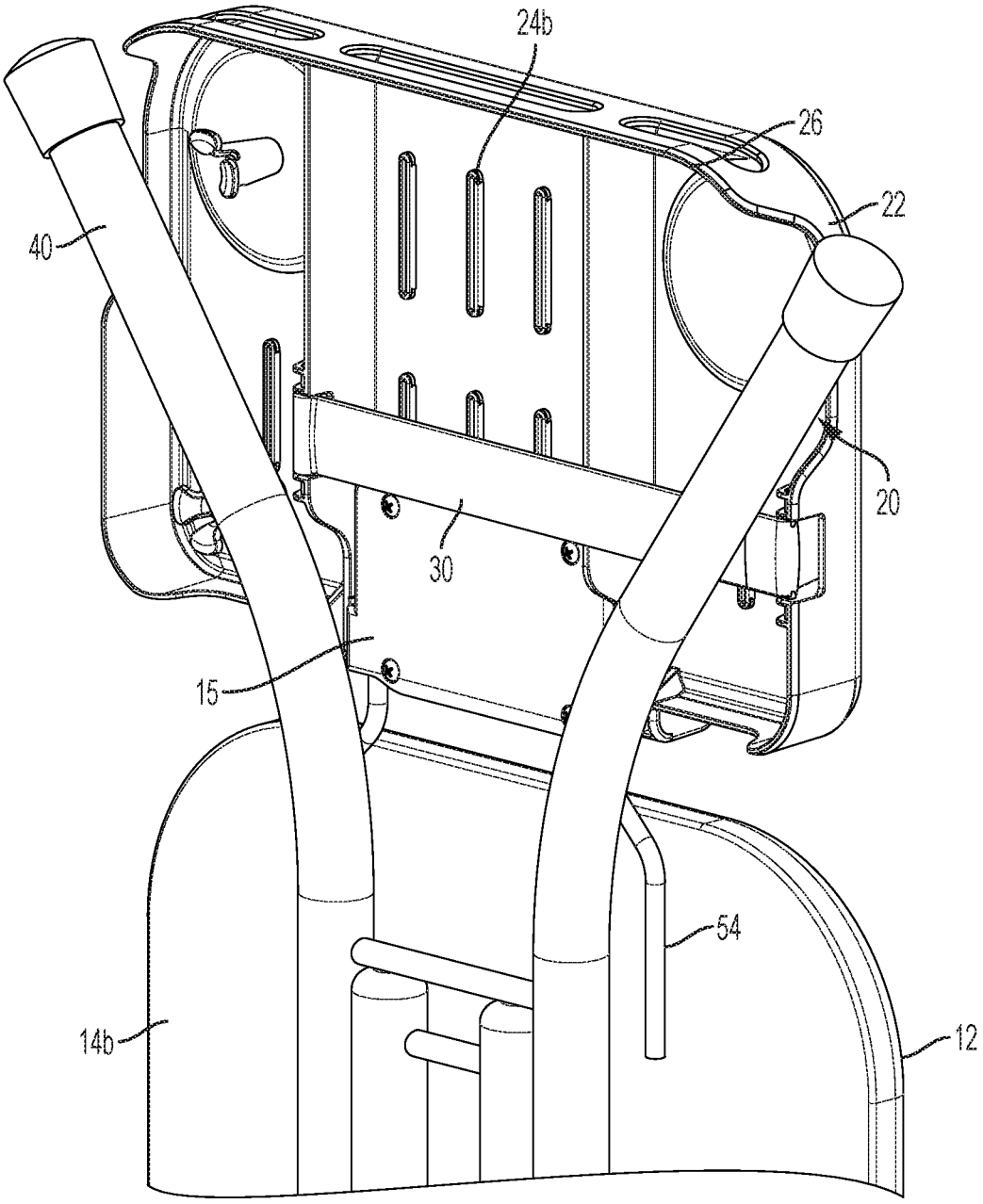
FIG. 4 is a bottom perspective view of the exemplary apparatus of FIG. 3 in the unfolded or open configuration.
Figure 5:
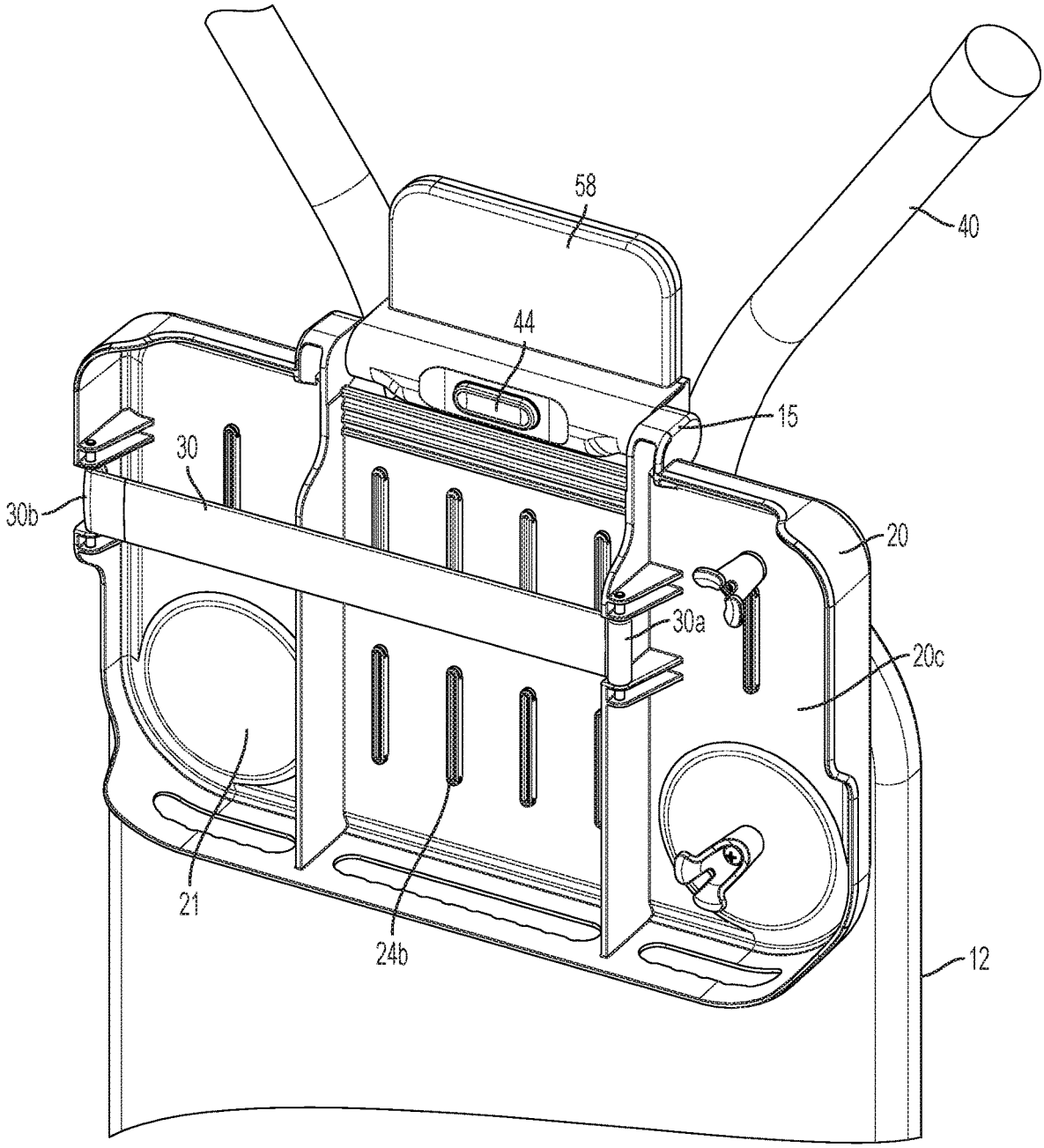
FIG. 5 is a top perspective view of the exemplary apparatus of FIG. 3 in a folded or closed configuration.

Referring to FIGS. 2-5, apparatus 200 comprises a board 12 having a top surface 14*a* and a bottom surface 14*b* and extending from a first end 12*a* to a second end 12*b*, and a tray 20 movably coupled with the board 12. The tray 20 extends from a first end 20*a* to a second end 20*b*. The tray 20 comprises a base portion 22 and a top portion 24 coupled with the base portion 22. The tray 20 is configured to be movable from an open configuration (FIGS. 3-4) to a closed configuration (FIG. 5 and FIG. 2). In the open configuration, one end such as the second end 20*b* of the tray 20 is extended away from the board 12. In the closed configuration, the tray 20 is folded such that it is positioned adjacent to a portion of the board 12. The tray 20 may be rotatable or slidable and be selectively positioned in the open or closed configuration.

In some embodiments, the first end 20*a* of the tray 20 is pivotally coupled to the first end 12*a* of the board 12. The tray 20 is pivotal about an axis (X as shown in FIG. 3) that is perpendicular to a longitudinal axis defined by the board 12 from its first end 12*a* to the second end 12*b* (Y as shown in FIG. 3). The tray can rotate around the axis Y.

The top portion 24 of the tray 20 is shaped and sized to support an iron 35 in the open configuration (similar to as illustrated in FIG. 1). In the closed configuration, the tray 20 is folded such that it is placed in direct contact with a portion of the board in some embodiments. For example, the top surface of the tray 20 is moved into contact with the top surface of the board 12. The open configuration is an in-use configuration and a pressing iron 35 can be placed onto the top portion 24 of the tray 20. The folded configuration is for storage.

The apparatus 200 further comprises at least two legs 40 such as four legs connected with the board 12 and configured to be collapsible or foldable toward the board 12 for storage. The legs 40 support the board when the apparatus 200 is in an in-use configuration.

Each of the base portion 22 and the top portion 24 of the tray 20 may comprise a polymer, a metal or a ceramic as described above. In some embodiments, the top portion 24 of the tray 20 is made of an elastomer, and the base portion 22 of the tray 20 is made of a plastics or a metal. Such an elastomer and such a plastics are thermal resistant as described. Examples of a suitable elastomer include but are not limited to silicone, fluorosilicone, fluoroleastomer (FKM), perfluoroelastomer (FFKM), or any combination thereof. Examples of a suitable plastic materials for the base portion 22 include, but are not limited to, polyamide such as polyphthalamide (PPA), polyester, polyphenylene sulfide (PPS), polyolefin, and any combination thereof. The elastomer and the plastic each have a temperature rating as described above. In some embodiments, the base portion 22 is made of metal or other thermally conductive material and functions as a heat sink. A hot iron can be packed with and contacts the back of the base portion 22.

Referring to FIGS. 3 and 6A-C, the top portion 24 of the tray 20 may be partially cover the base portion 22. The top portion 24 may include a patterned surface having patterns 24*a* to increase the friction between the top portion 24 and an iron 35. In some embodiments, the base portion 22 or the top portion 24 defines at least one depression 21 configured to hold a bottle (such as a spraying bottle or spray can), a cup, a container or the like. The depression 21 may have a circular opening. The tray 20 may have a suitable dimension. For example, the tray 20 may have a length (L) the same as the width of the board 12, and a width (W) large enough to accommodate an iron.

Figure 6A:
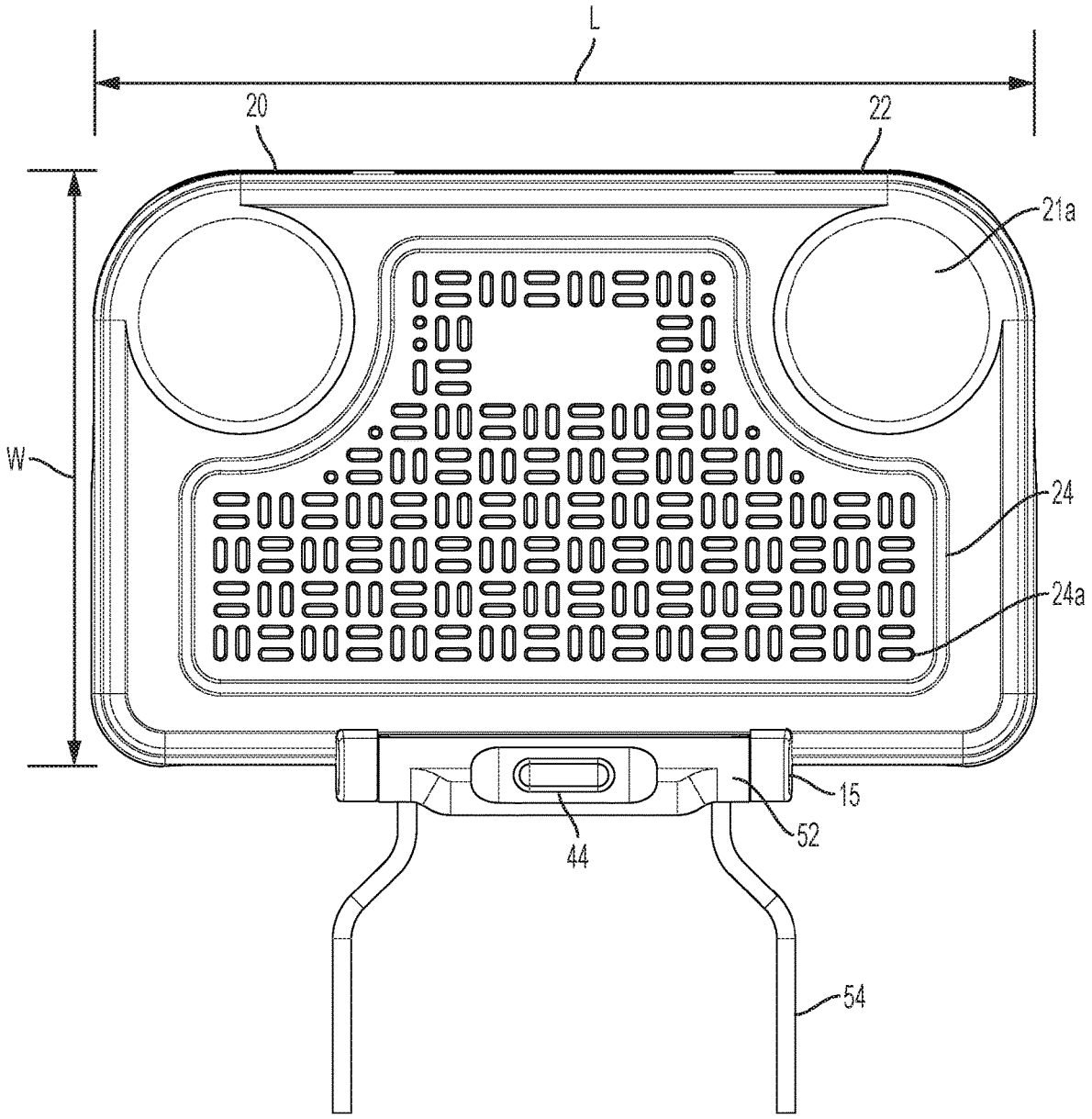
FIG. 6A is a top plan view illustrating a portion including an exemplary tray and an exemplary hinge bracket in the exemplary apparatus of FIG. 3 in accordance with some embodiments.

Referring to FIG. 3, in some embodiments, the base portion 22 of the tray 20 comprises a side wall or a hanger portion 26 defining an opening (at least two openings) 28. The openings 28 function as the hanger rails configured to hold one or more clothes hangers 33 (as illustrated in FIG. 1). Referring to FIG. 6C, the tray 20 may have a thickness (d) to provide openings 28 of a suitable size for hangers 33.

Figure 6B:
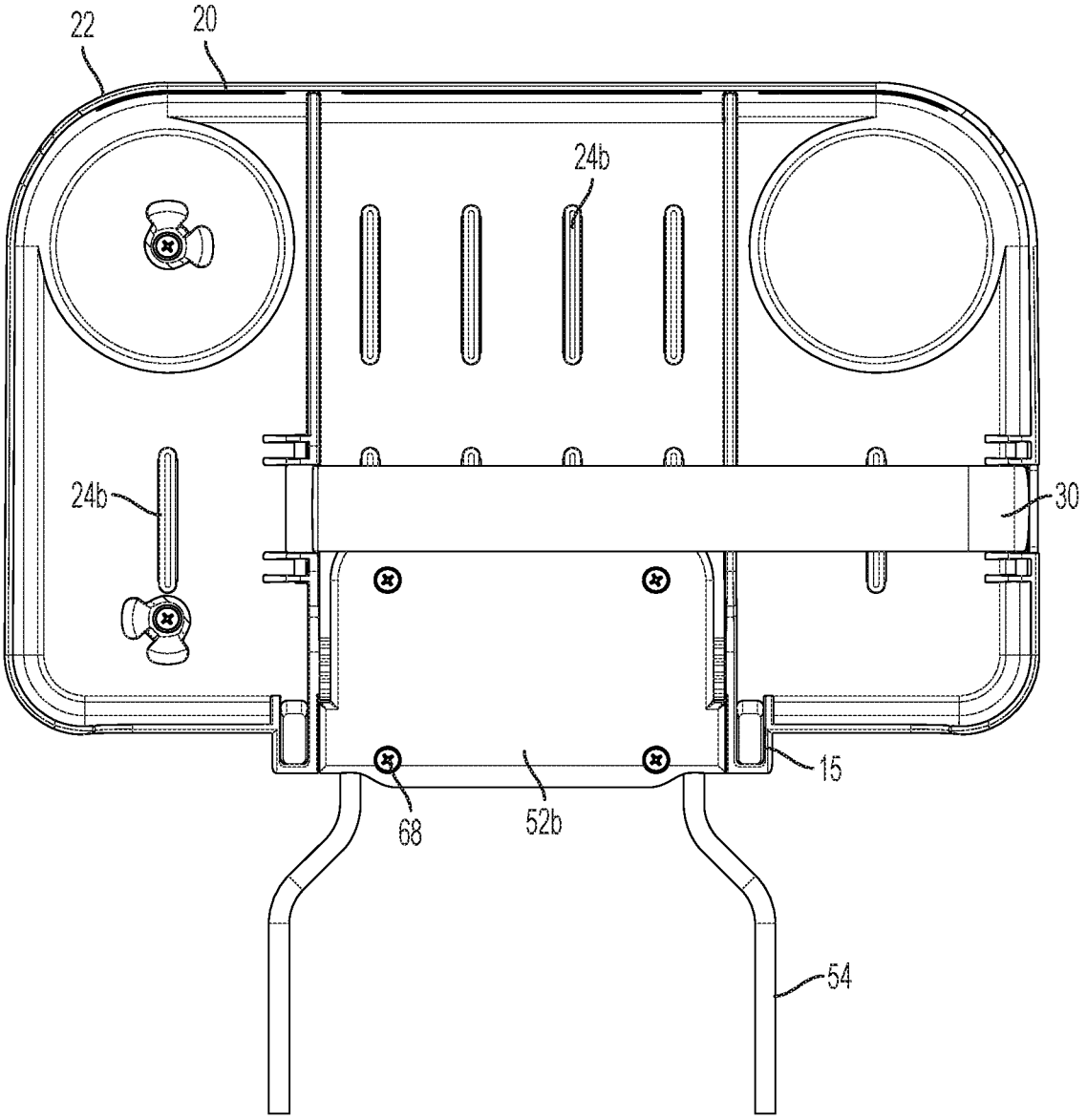
FIG. 6B is a bottom plan view illustrating the exemplary tray and the exemplary hinge bracket of FIG. 6A.
Figure 6C:
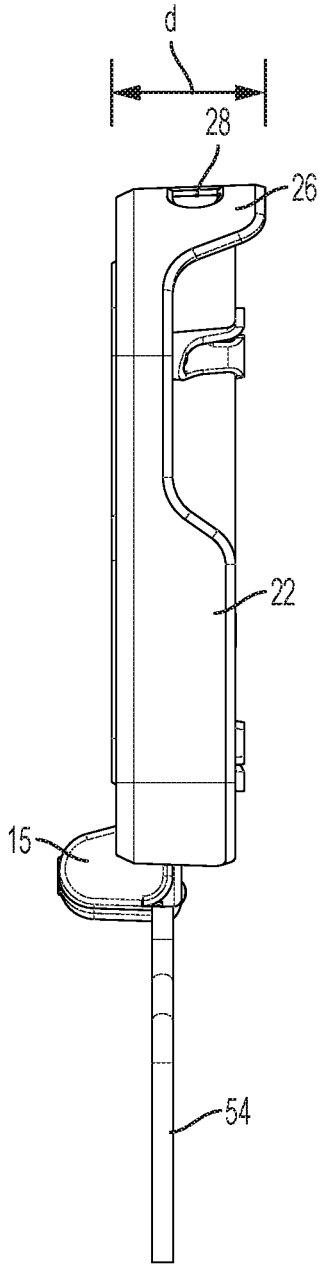
FIG. 6C is a side view illustrating the exemplary tray and the exemplary hinge bracket of FIG. 6A.

Referring to FIGS. 4, 5 and 6B, the apparatus 200 may further comprise a strap or belt 30 disposed on a back wall of the tray 20 and configured to fasten an iron 35 when the tray 20 in the closed configuration (as illustrated for the apparatus 100 in FIG. 2).

Referring to FIGS. 3, 5 and 6A, the apparatus 200 may further comprise a hinge device 15 disposed between and coupled to the board 12 and the tray 20. In some embodiments, the hinge device 15 comprises a button 44 and a lock 62 (described below in FIGS. 7 and 8D) configured to lock the tray 20 in the open or closed configuration and release the tray 20 so that the tray is movable between the open configuration and the closed configuration. In some embodiments, the hinge device 15 comprises a hinge bracket 52. The base portion 22 of the tray 20 are coupled with the hinge bracket 52 to function as a hinge.

Referring to FIGS. 3, 4 and 6A-6C, in some embodiments, the apparatus 200 may further comprise a supporting member 54 connected with the hinge device 15 and the board 12.

Figure 7:
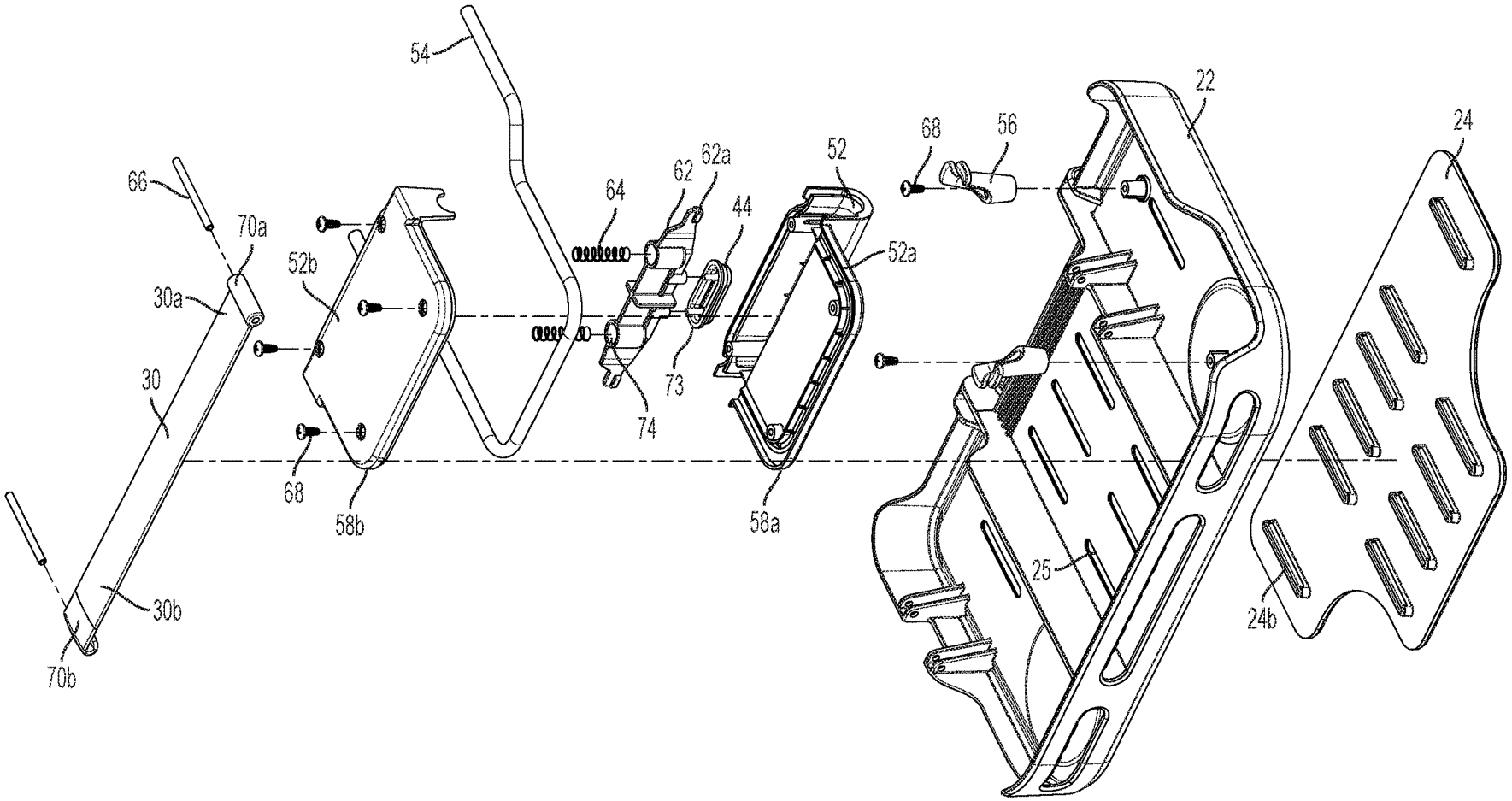
FIG. 7 is an exploded view illustrating some exemplary parts in the exemplary apparatus of FIG. 3 in accordance with some embodiments.

FIG. 7 is an exploded view illustrating some exemplary parts in the exemplary apparatus 200 in accordance with some embodiments. From left-to-right in FIG. 7 these parts include: the top portion 24 of the tray 20, the base portion 22 of the tray 20, at least one cable wrapping post 56, a hinge bracket 52 including two pieces 52*a* and 52*b*, a button 44, a lock 62, at least one spring 64, a supporting member 54, the belt 30 and the pins 66. FIGS. 8A-8F illustrate some parts in details separately.

Figure 8A:
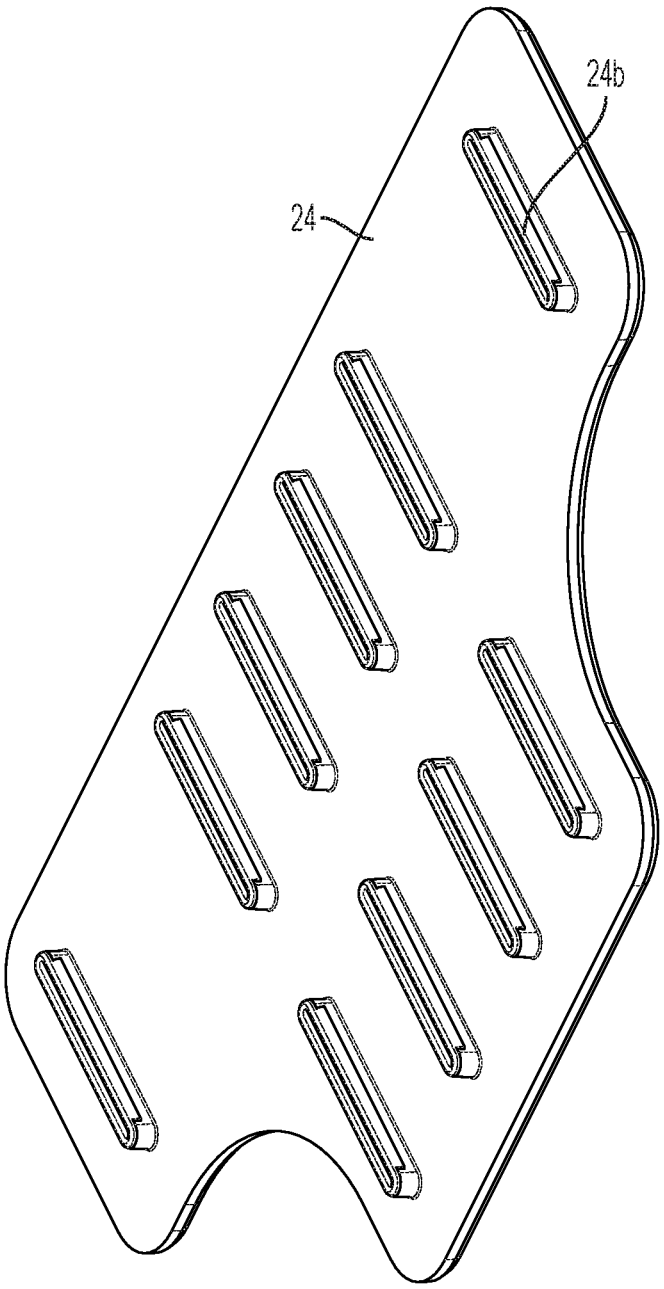
FIGS. 8A-8F illustrate some exemplary parts of FIG. 7.
Figure 8B:
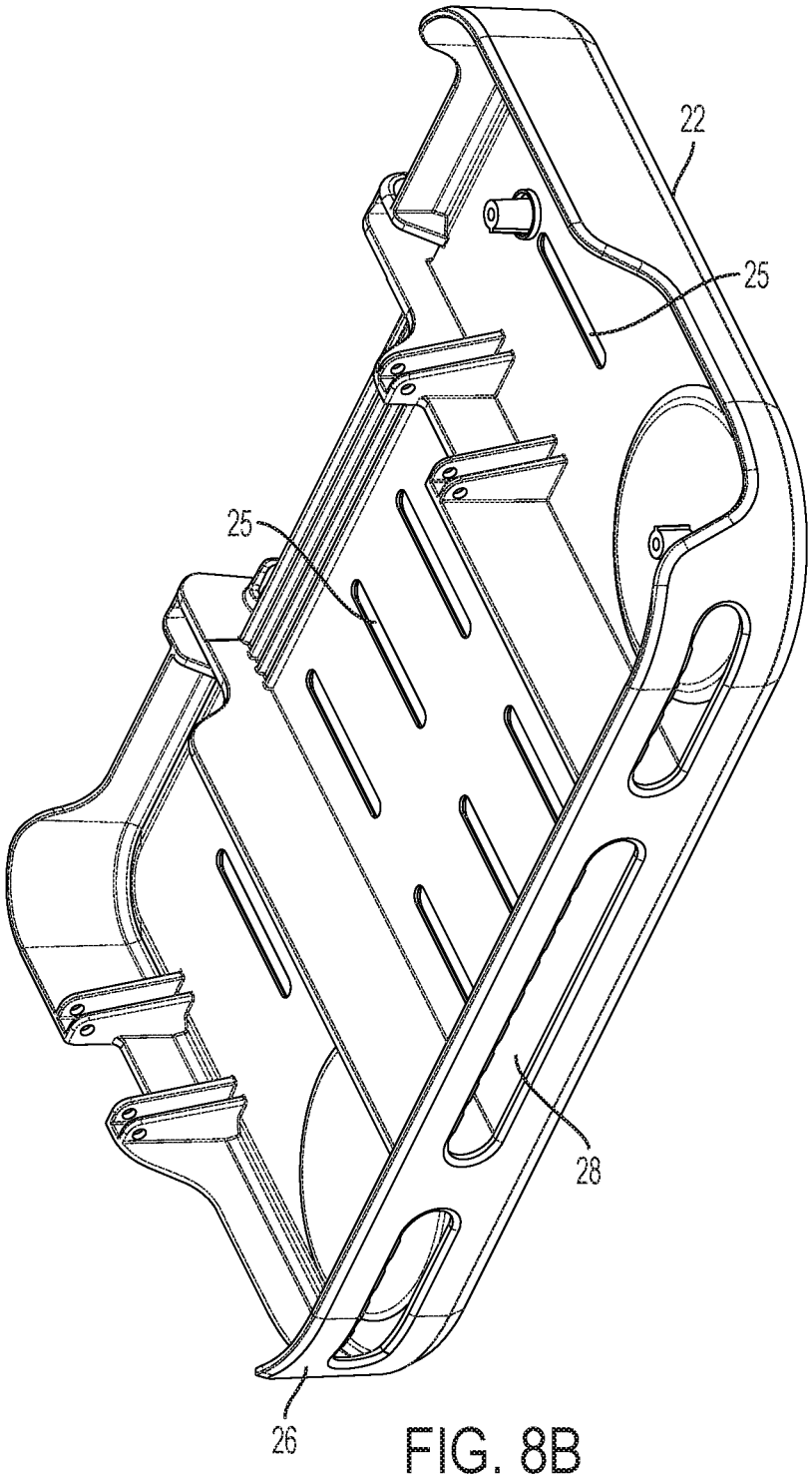

Referring to FIGS. 7 and 8A-8B, in some embodiments, the top portion 24 of the tray 20 may have patterned protrusions 24*b* on the back surface. The protrusions 24*b* may be in elongated shape as illustrated in FIG. 8A. The base portion 22 of the tray 20 defines corresponding slots 25. During manufacturing, the protrusions 24 are pushed into the corresponding slots 25 of suitable sizes so the base portion 22 and the top portion 24 of the tray 20 are mechanically interlocked with each other. In some other embodiments, the top portion 24 may be molded or bonded onto the base portion 22 of the tray 20.

Referring again to FIG. 7, one or more cable wrapping posts 56 may be disposed on the back of the base portion 22. In some embodiments, two cable wrapping posts 56 may be fixed onto the base portion 22 with screws 68, and are so configured that a cable or wire from an iron 35 can be wrapped and fixed when the tray 20 is in the closed configuration.

Figure 8C:
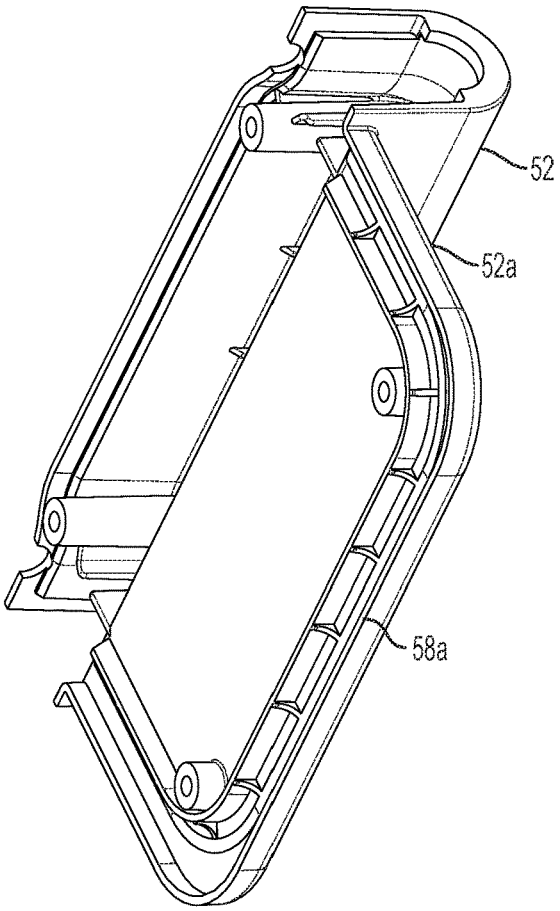
Figure 8D:
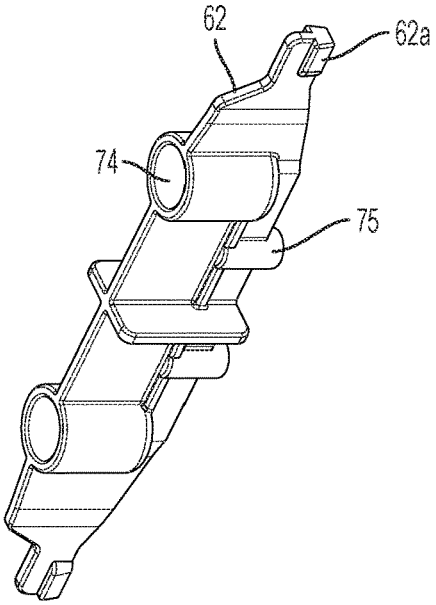

Referring to FIGS. 7 and 8C-8F, in some embodiments, a hinge bracket 52 includes two pieces 52*a* and 52*b*, which are assembled together using screws 68 to define an enclosure. In the apparatus 200, the lock 62 is disposed inside the enclosure of the hinge bracket 52. The button 44 is partially disposed inside such an enclosure. The button 44 is connected with the lock 62 and partially exposed outside the hinge bracket 52. In some embodiments, the button 44 is coupled with the lock 62 through the pins 73 on the button 44 and holes 75 on the lock 62. The lock 62 also defines two holes 74 configured to hold two springs 64 disposed between a bottom piece 52*b* of the hinge bracket 52. Referring to FIGS. 7, 8D and 9, in some embodiments, the lock 62 also includes two ends 62*a*. The two ends 62*a* may have a hooked structure, each of which is configured to lock a corresponding portion 75 in the hinge device 15 or the base portion 22 of the tray 20 so that the tray 20 is fixed and not movable. When the button 44 is pushed, the lock 62 does not interact with the corresponding portion 75 in the hinge device 15 or the base portion 22 of the tray 20 so that the tray 20 can be rotatably movable. In the hinge device, the lock 62 and the button 44 are configured to lock the tray in the open or closed configuration and release the tray 20 so that the tray 20 is movable between the open configuration and the closed configuration. When the tray 20 is in the open or closed configuration, the lock 62 may automatically returns to the locking position and locks the tray 20.

Figure 8E:
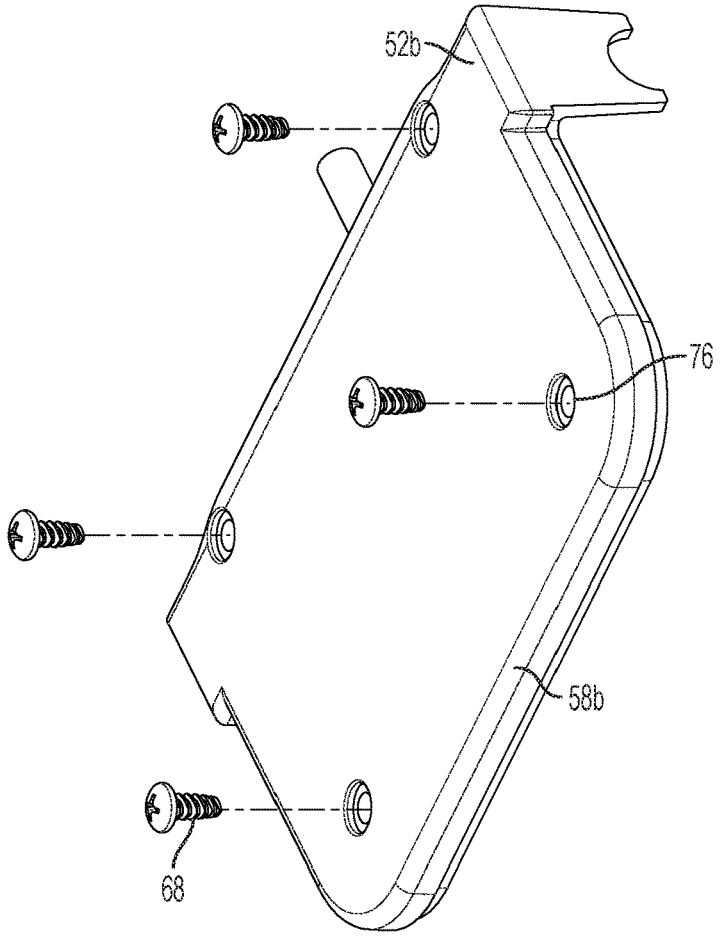
Figure 8F:
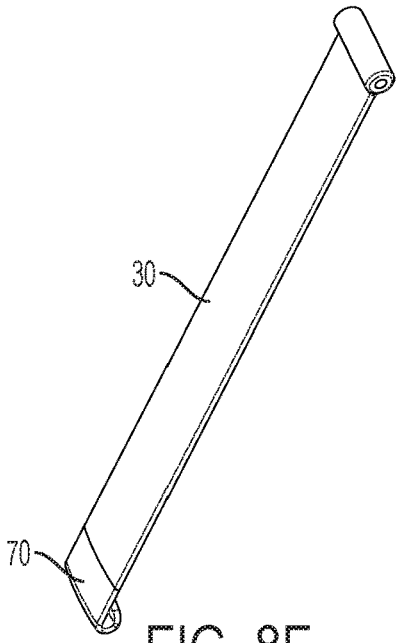
Figure 9:
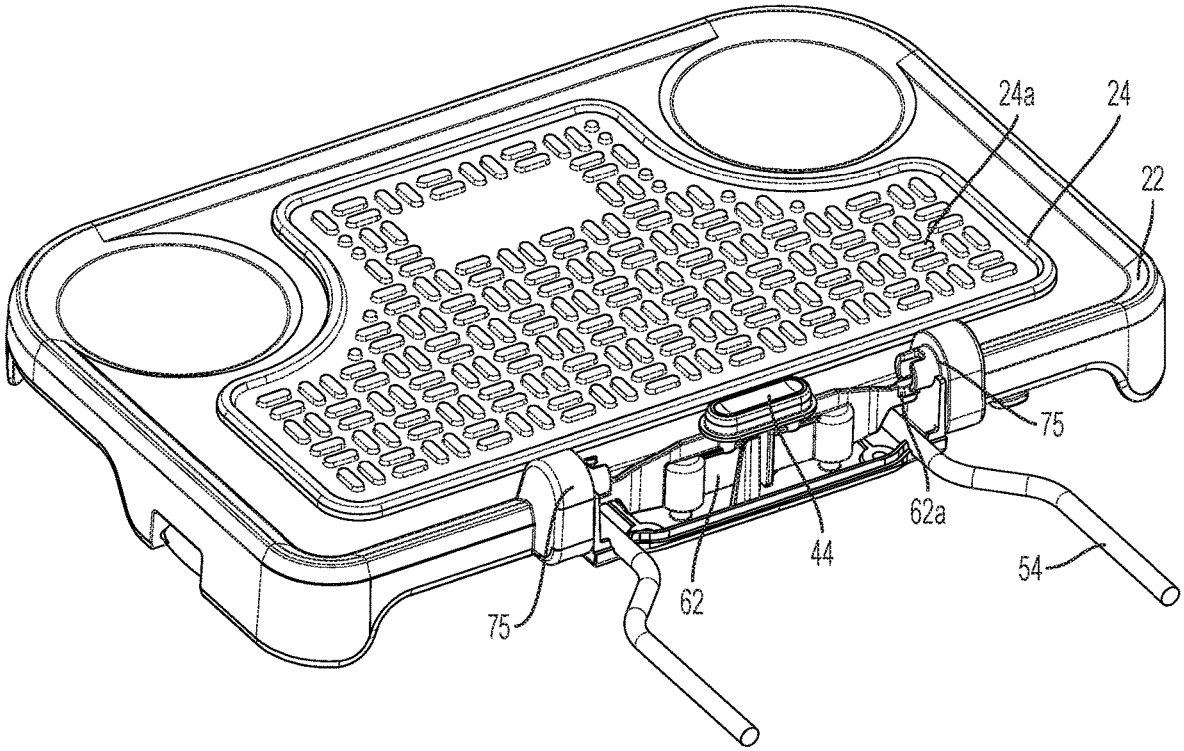
FIG. 9 is a perspective view illustrating a portion including the exemplary tray and the exemplary hinge bracket in the exemplary apparatus of FIG. 3 in accordance with some embodiments.

Referring to FIGS. 7, 8C and 8E, in some embodiments, a hinge bracket 52 may include a shelf 58 extending away from the board 12. The shelf 58 includes two pieces 58*a* and 58*b*. The shelf 58 is configured to partially support the tray 20 disposed above the shelf 58 when the tray 20 is in the open configuration. The hinge device 15, including the shelf 58, is not movable in some embodiments. Referring to FIG. 5, when the tray 20 moves to the closed configuration, the hinge device 15, including the shelf 58, maintains a fixed position.

Figure 10:
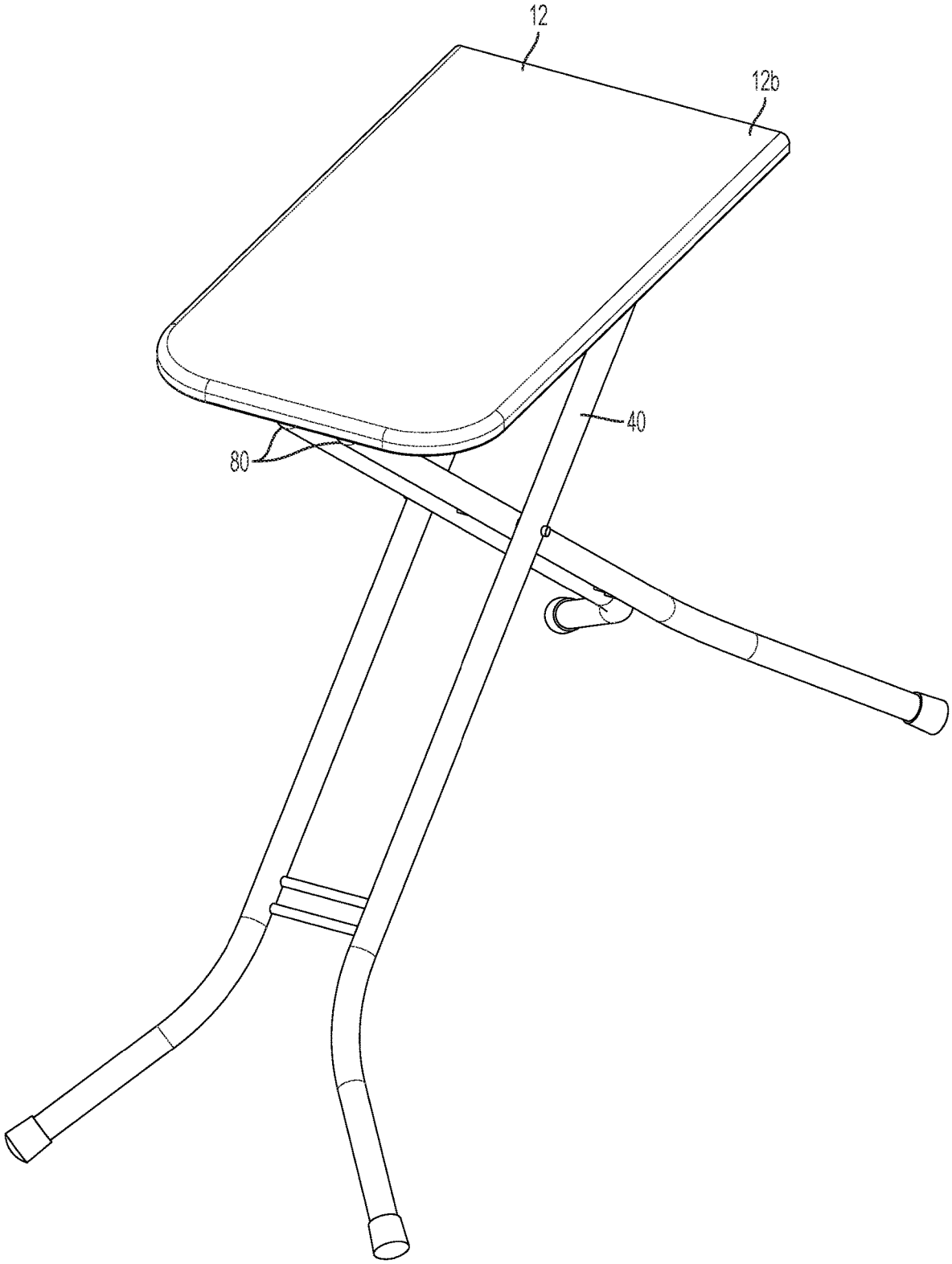
FIG. 10 is a perspective view illustrating a portion including an exemplary board and exemplary supporting legs in accordance with some embodiments.

Referring to FIGS. 7, 9 and 10, in some embodiments, the apparatus 200 further comprises a supporting member 54 connected with the hinge device 15 and the board 12. The supporting member 54 may be a wire or rod (e.g., U-shaped metal wire) partially disposed inside the hinge bracket 52 so as to be connected with the hinge device 15. The supporting member 54 include two ends, which are inserted into two holes 80 on the bottom of the board 12. The parts as shown in FIGS. 9-10 are combined to form the apparatus 200.

Referring to FIG. 7 and FIG. 5, the belt 30 has two ends: a first end 30*a* and a second end 30*b*. The first end 30*a* is fixed to the back of the tray 20 through a first hook 70*a* in the first end and a first pin 66 on the back of the tray 20. The pin 66 is inserted into the hook 70. The second end 30*b* of the belt 30 has a second hook 70*b*, which can be removably coupled with a second pin 66 on the back of the tray 20. The first hook 70*a* is a closed hook while the second hook 70*b* may be partially open and be reversibly uncoupled from the second pin 66. The belt 30 is configured to partially wrap around the tray 20 and fasten an iron onto the back of the tray after the tray 20 is folded onto the board 12. The second end of the belt 30 is then coupled with the second pin 66. In some embodiments, the belt comprises an elastomer such as thermoplastic elastomer (TPE), which may be reinforced with glass fibers.

In another aspect, the present disclosure provides a method of manufacturing the apparatus 200 as described. Such a method comprises steps of providing the board 12 as described, and forming the tray 20 as described. The method further comprises forming a hinge device 15, and assembling the board 12, the tray 20 and the hinge device 15 together. The hinge device 15 is placed between and coupled with the board 12 and the tray 20. In some embodiments, the supporting member 54 is installed as described.

In another aspect, the present disclosure provides a method of using the apparatus 200 as described. Such a method comprises moving the tray 20 from the open configuration to the closed configuration or from the closed configuration to the open configuration. An iron 35 can be placed onto the top portion 24 when the tray 20 is in the open configuration. The iron 35 can be placed and fixed onto a back wall of the base portion 22 when the tray 20 is in the closed configuration.

Although the subject matter has been described in terms of exemplary embodiments, it is not limited thereto. Rather, the appended claims should be construed broadly, to include other variants and embodiments, which may be made by those skilled in the art.

What is claimed is:

1. An apparatus comprising:

a board having a top surface and a bottom surface;

a tray extending from a first end to a second end, the first end of the tray being movably coupled with the board, the tray comprising a base portion, and a top portion coupled with the base portion; and a flexible strap or belt coupled to the tray, wherein the tray is configured to be selectively positioned in an open configuration in which the tray extends away from the board and in a closed configuration in which the second end and a first surface of the tray are disposed adjacent to the board, the first surface of the tray for supporting an iron when the tray is in the open configuration, and the first surface of the tray facing the top surface of the board when the tray is in the closed configuration, wherein the strap or belt is configured to fasten the iron to a second surface of the tray when the tray in the closed configuration.

2. The apparatus of claim 1, wherein the first end of the tray is pivotally coupled to a first end of the board.

3. The apparatus of claim 1, wherein the top portion of the tray is made of an elastomer, and the base portion of the tray is made of a metal or a plastics.

4. The apparatus of claim 1, wherein the top portion of the tray is mechanically interlocked with, or molded or bonded onto, the base portion of the tray.

5. The apparatus of claim 1, further comprising a hinge device disposed between and coupled with the board and the tray.

6. The apparatus of claim 5, wherein the hinge device comprises at least one hinge.

7. The apparatus of claim 5, wherein the hinge device comprises a hinge bracket.

8. The apparatus of claim 7, wherein the hinge bracket includes a shelf extending away from the board and configured to partially support the tray disposed above the shelf in the open configuration.

9. The apparatus of claim 5, wherein the hinge device comprises a lock and a button configured to lock the tray in the open or closed configuration and release the tray so that the tray is movable between the open configuration and the closed configuration.

10. The apparatus of claim 5, further comprising a supporting member for supporting the tray, the supporting member connected with the hinge device and the board.

11. The apparatus of claim 1, wherein the base portion or the top portion of the tray defines at least one depression configured to hold a bottle, a cup, or a container.

12. The apparatus of claim 1, wherein the base portion of the tray comprises a side wall defining at least one hanger rail configured to hold one or more hangers.

13. The apparatus of claim 1, further comprising at least two legs connected with the board and configured to be collapsible toward the board for storage.

14. A method of manufacturing the apparatus of claim 1, comprising:

providing the board; and forming the tray.

15. The method of claim 14, further comprising:

forming a hinge device; and assembling the board, the tray and the hinge device together, wherein the hinge device is placed between and coupled with the board and the tray.

16. A method of using the apparatus of claim 1, comprising:

moving the tray from the open configuration to the closed configuration or from the closed configuration to the open configuration.

17. The method of claim 16, further comprising placing an iron onto the top portion of the tray when the tray is in the open configuration.

18. The method of claim 16, further comprising fixing an iron onto a back wall of the base portion of the tray when the tray is in the closed configuration.

19. The apparatus of claim 1, wherein the base portion of the tray has one side defining a gap, and the strap or belt is coupled to and extended from the one side of the tray through the gap.

20. An apparatus comprising:

a board having a top surface and a bottom surface;

a tray extending from a first end to a second end, the first end of the tray being movably coupled with the board, the tray comprising a base portion, and a top portion coupled with the base portion;

a hinge device disposed between and coupled to the board and the tray; and a strap coupled to the tray, wherein the tray is configured to be selectively positioned in an open configuration in which the tray extends away from the board and in a closed configuration in which the second end and a first surface of the tray are disposed adjacent to the board, the first surface of the tray for supporting an iron when the tray is in the open configuration, and the first surface of the tray facing the top surface of the board in the closed configuration, wherein the strap is coupled with a back wall of the tray and configured to fasten the iron on a second surface of the tray when the tray in the closed configuration.

21. The apparatus of claim 20, wherein the hinge device comprises a lock and a button configured to lock the tray in the open or closed configuration and release the tray so that the tray is movable between the open configuration and the closed configuration.

* * * * *